United States Patent [19]

Röck et al.

[11] Patent Number: 4,691,408

[45] Date of Patent: Sep. 8, 1987

[54] FURNITURE HINGE HAVING A RESILIENT CATCH AND SPACER MECHANISM

[75] Inventors: Erich Röck, Höchst; Helmut Rupprechter; Klaus Brüstle, both of Lauterach, all of Austria

[73] Assignee: Julius Blum Gesellschaft m.b.H., Höchst, Austria

[21] Appl. No.: 783,639

[22] Filed: Oct. 3, 1985

[30] Foreign Application Priority Data

Oct. 19, 1984 [AT] Austria ..... 3339/84

[51] Int. Cl.[4] ..... E05D 7/06

[52] U.S. Cl. ..... 16/241; 16/246; 16/382

[58] Field of Search ..... 16/241, 245, 246, 382, 16/DIG. 39, 238, 370

[56] References Cited

FOREIGN PATENT DOCUMENTS 2513089 10/1975 Fed. Rep. of Germany ..... 16/246
3026796 3/1982 Fed. Rep. of Germany .
3039328 5/1982 Fed. Rep. of Germany .
3241284 5/1984 Fed. Rep. of Germany .
1505716 3/1978 United Kingdom .
1506252 4/1978 United Kingdom ..... 16/272
1522807 8/1978 United Kingdom ..... 16/382

*Primary Examiner*—Fred Silverberg
*Attorney, Agent, or Firm*—Wenderoth, Lind & Ponack

[57] ABSTRACT

A furniture hinge includes a hinge arm having a U-shaped profile and being pushable onto a mounting plate. The hinge arm and the mounting plate have lateral projections and recesses which engage one another. The hinge arm can be locked from movement in the direction of displacement by a resilient steel member which is held at the hinge arm by an eccentric for achieving adjustment of the hinge arm in the direction of the depth of the article of furniture. The steel member is formed as an intermediate element which fully supports the hinge arm.

5 Claims, 7 Drawing Figures

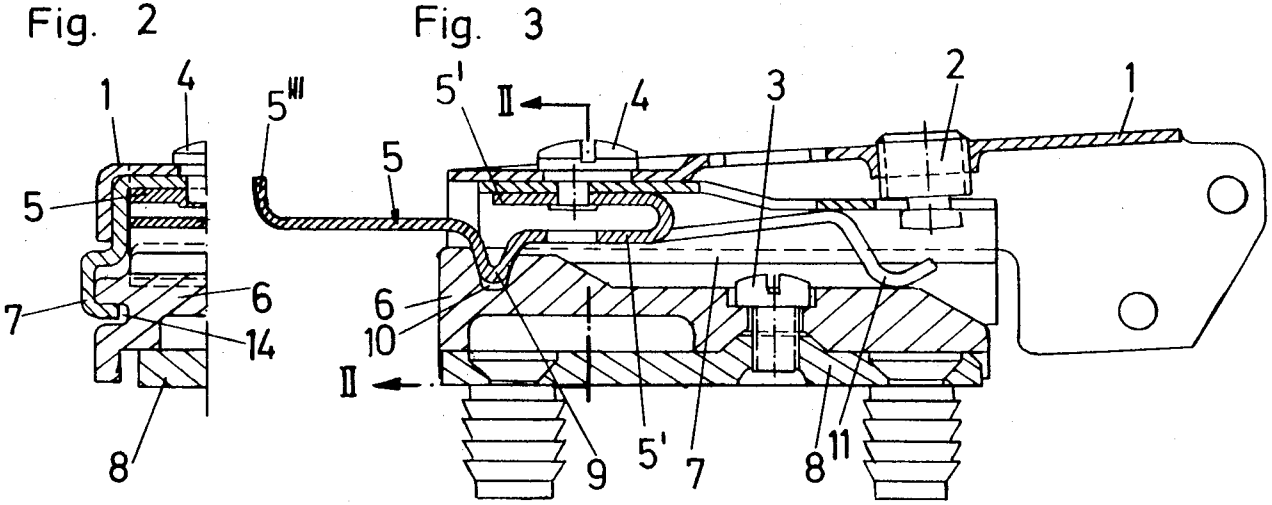
Fig. 3
Fig. 2
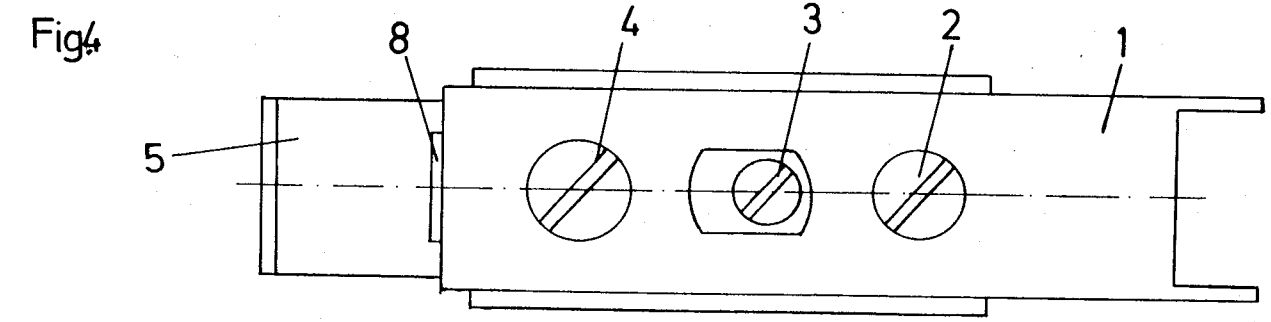
Fig. 4

FURNITURE HINGE HAVING A RESILIENT CATCH AND SPACER MECHANISM

FIELD AND BACKGROUND OF THE INVENTION

The invention relates to a hinge comprising a hinge arm having a U-shaped profile and being pushable onto a mounting plate, the hinge arm and the mounting plate having lateral projections and recesses engaging one another, the hinge arm being lockable from further movement in the direction of displacement by means of a resilient steel member held at the hinge arm by means of an adjustment element for achieving depth adjustment of the hinge arm, and a further adjustment screw for the joint being provided.

DESCRIPTION OF THE PRIOR ART

In conventional hinges, the hinge arm is fastened to the mounting plate by means of a clamping screw which generally projects through an oblong hole to permit adjustment of the hinge arm in the direction of the depth of the piece of furniture.

Recently, snap-in connections for fastening the hinge arm to the mounting plate have become known. Nos. DE-A-30 26 796 and DE-A-30 39 328, for example, show hinges comprising a hinge arm and a fastening plate in which the two parts to be locked to each other snap into each other by inserting the hinge arm into a guide of the fastening plate and by displacing the hinge arm in the longitudinal direction. A similar anchoring of a hinge arm to a mounting plate is shown in No. DE-A-32 41 284 in which the hinge arm is insertable into lateral guides of a mounting plate and clampable to the mounting plate by means of an eccentric.

The above-described anchoring of a hinge arm to a mounting plate has the advantage that the hinge arm can be fixed to the mounting plate very quickly when the piece of furniture is assembled, and, further, that no tools are required for the mounting operation. Such advantage is not unimportant because the furniture door must be held, when the hinge arms are mounted. When, for example, the door is held with one hand and the hinge arm to be mounted with the other hand, a second person is often needed to fasten the clamping screw by means of a screw driver, if the hinge arm is locked by means of a clamping screw.

SUMMARY OF THE INVENTION

It is the object of the invention to improve a hinge with a resilient snap-in connection in such a way that it is of simple construction and that a depth adjustment of the hinge arm is possible when the hinge arm has been mounted onto the mounting plate.

According to the invention this is achieved in that a steel member, regions of which have U-shaped profile, is formed as an intermediate element fully supporting the hinge arm, and that the adjustment screw for the joint abuts, on the one side, at the hinge arm, and on the other side, at the steel member.

An embodiment of the invention provides that one or two spreading members project from the steel member and act on the mounting plate, on one side, and on the hinge arm or an intermediate element associated with the hinge arm, on another side, and spread the parts apart with a clamping effect.

BRIEF DESCRIPTION OF THE DRAWINGS

In the following an embodiment of the invention will be described in more detail with reference to the accompanying drawings, in which:

FIG. 2 is a cross-sectional view of the hinge arm and the mounting plate, FIG. 3 is a longitudinal sectional view of the hinge arm and the mounting plate in the mounted position, FIG. 4 is a top view of the hinge arm mounted on the mounting plate.

Figure 1:
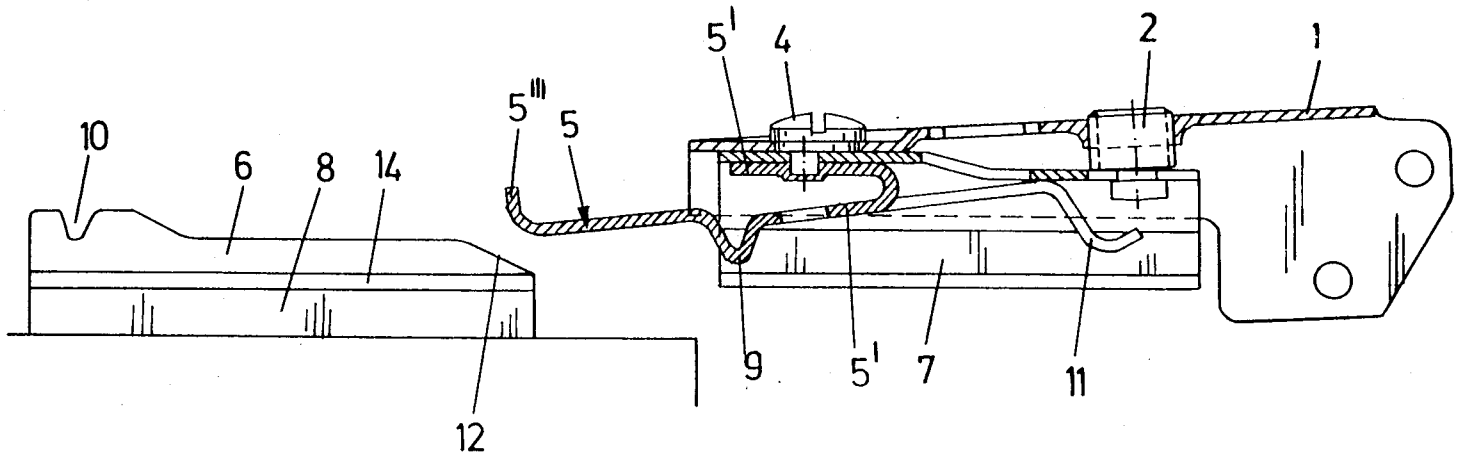
FIG. 1 is a schematic side view of a hinge arm and a mounting plate of a hinge is accordance with the invention, with the parts shown spaced apart, and with the hinge arm in section.

In the drawings the hinge parts which are not directly related to the invention, such as the hinge casing and the hinge link, are not shown.

DESCRIPTION OF THE PREFERRED EMBODIMENTS

As can be seen from FIGS. 1 to 3, the hinge according to the invention comprises a two-part mounting plate 6,8, a hinge arm 1, an intermediate element 7 and a catch element which is formed as steel member 5.

The steel member 5 is riveted to an eccentric 4 which is mounted in the hinge arm 1 and thus is connected with the hinge arm 1 and the intermediate element 7.

At the front, i.e. near its end at the side of a hinge link, the hinge arm 1 has a joint adjustment screw 2 mounted in a female thread of hinge arm 1 and in a slot of the intermediate element 7.

The two parts 6, 8 of the mounting plate are held together by means of a clamping screw 3. When the clamping screw is released, the piece 6 can be displaced on the piece 8, thus effecting a vertical adjustment of the hinge.

When viewed from the side, the steel member 5 of FIG. 3 is substantially U-shaped and comprises two flanges or arms 5'. The steel member further has a portion 9 bent to form a V which engages in a corresponding recess 10 of part 6 of the mounting plate 6, 8, when the hinge arm 1 has been pushed onto the mounting plate 6, 8. A handle member 5''' adjoins the V-shaped portion 9 of the steel member 5.

The steel member 5 is further provided with two spreading members 11 which are bent from the material of the steel member 5 and extend in a direction opposite to the handle member 5'''.

When the hinge arm 1 has been pushed onto the mounting plate, the spreading members 11 press, on the one side, against the mounting plate 6, 8 and, on the other side, against the intermediate element 7, so that the parts are held together without clearance.

For mounting, the hinge arm 1 need only be pushed onto the mounting plate 6, 8 by means of the intermediate element 7. The V-shaped portion 9 of the steel member 5 snaps into the recess 10 automatically.

To facilitate the mounting of the hinge arm 1, the front of part 6 is provided with an oblique surface 12.

When the hinge arm 1 has been mounted on the mounting plate 6, 8, adjustments of the hinge in the direction of the door joint, i.e. adjustment of arm 1 toward or away from plate 6, 8, and in the direction of the depth of the piece of furniture, i.e. adjustment of arm 1 parallel to plate 6, 8, can be effected in a conventional manner by turning the joint adjustment screw 2 and the eccentric 4, respectively.

To release the steel member 5, the handle member 5''' need only be lifted, and the hinge arm 1 can then be taken off the mounting plate 6, 8.

Figure 5:
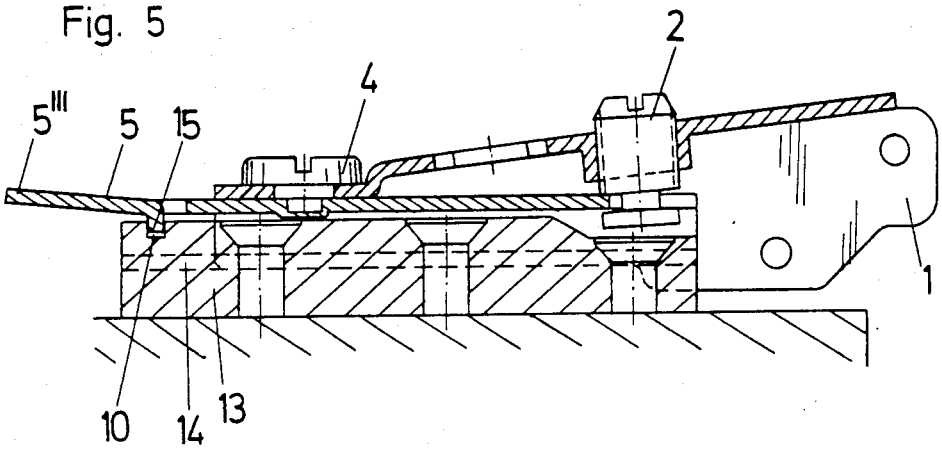
FIG. 5 is a longitudinal sectional view of the hinge arm and the mounting plate of a second embodiment of the invention.
Figure 6:
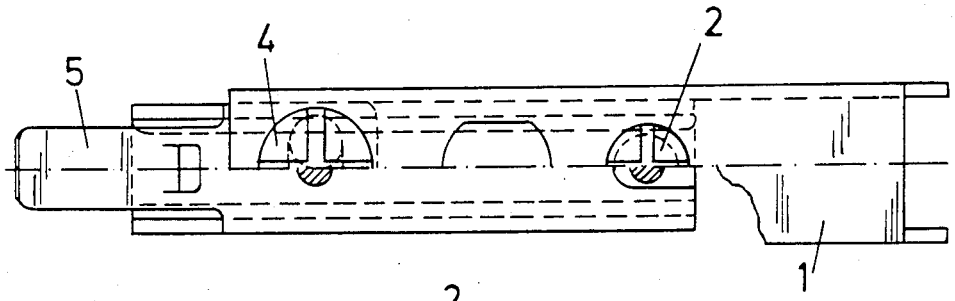
FIG. 6 is a top view of the hinge arm according to FIG. 5.
Figure 7:
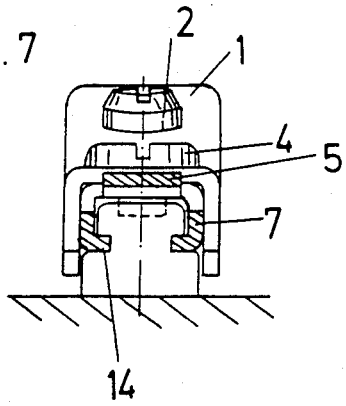
FIG. 7 is a cross-sectional view of the hinge arm and the mounting plate according to the embodiment of FIGS. 5 and 6.

In the embodiment according to FIGS. 5 to 7, the steel member 5 and the intermediate element 7 having a C-shaped profile are made of one piece.

The steel member 5 is again held at the hinge arm 1 by means of the eccentric 4 and, in this arrangement, also by the joint adjustment screw 2.

The mounting plate 13 has, like the mounting plate 6, 8 of the afore-described embodiment, lateral grooves 14 into which the steel member 5 is insertable.

The steel member 5 has a catch projection which is punched out of the steel member 5 and is integral with the handle member 5''' of the steel member.

For mounting, the hinge arm 1 need only be pushed onto the mounting plate 13, as described in the previous embodiment. Equally, adjustments in the direction of the joint and in the direction of the depth of the piece of furniture are effected by turning the joint adjustment screw 2 and the eccentric 4, respectively.

If the hinge arm 1 is to be released from the mounting plate 13, the handle member 5''' is lifted, which is possible because of the resilient character of the steel member 5. The catch projection 15 is thus lifted from the recess 10 in the mounting plate 13, and the hinge arm 1 can be taken off the mounting plate 13.

What is claimed is:

1. A furniture hinge comprising:

a mounting plate to be mounted on a wall of an article of furniture, said mounting plate having therein a surface recess;

a hinge arm having a U-shaped profile and to be connected to a door of the article of furniture;

an intermediate member for mounting said hinge arm on said mounting plate, said intermediate member being connected to said hinge arm by means of an adjustment screw for adjusting the spacing between said hinge arm and said mounting plate;

said mounting plate and said intermediate member having interengaging lateral recesses and projections extending in a longitudinal direction, such that said intermediate member and thus said hinge arm may be moved in said direction and mounted on said mounting arm;

said intermediate member including means for limiting the movement of and locking the position of said intermediate member and said hinge arm in said direction relative to said mounting plate, said locking means comprising a resilient member having a catch projection which snaps into said surface recess in said mounting plate upon movement of said intermediate member and said hinge arm in said direction, said resilient member being connected to said hinge arm by an adjustment member for adjusting the position of said hinge arm relative to said mounting plate and said resilient member in said direction; and said resilient member including an integral handle forming means for enabling manual resilient deformation of said resilient member to release said catch projection from said recess, whereafter said intermediate member and said hinge arm can be withdrawn from said mounting plate.

2. A hinge as claimed in claim 1, wherein said resilient member is formed of steel.

3. A hinge as claimed in claim 1, wherein said resilient member is substantially U-shaped and includes first and second arms, said first arm is connected to said intermediate member and to said hinge arm by means of said adjustment member, and said catch projection and said integral handle extend integrally from said second arm.

4. A hinge as claimed in claim 1, wherein said resilient member includes integral spreading means contacting and urging apart said mounting plate and said intermediate member.

5. A hinge as claimed in claim 1, wherein said intermediate member and said resilient member comprise an integral, one-piece element.

* * * * *